US011002420B2

(12) United States Patent
Dey et al.

(10) Patent No.: US 11,002,420 B2
(45) Date of Patent: May 11, 2021

(54) VEHICLE HEADLAMP HAVING LIGHT GUIDE

(71) Applicant: MAGNA EXTERIORS INC., Concord (CA)

(72) Inventors: Rajat Dey, Concord (CA); Kevin Polzin, Concord (CA); Jose A. Bonequi, Concord (CA); Steve Kowalski, Concord (CA)

(73) Assignee: MAGNA EXTERIORS INC., Concord (CA)

( * ) Notice: Subject to any disclaimer, the term of this patent is extended or adjusted under 35 U.S.C. 154(b) by 0 days.

(21) Appl. No.: 16/678,669

(22) Filed: Nov. 8, 2019

(65) Prior Publication Data

US 2020/0200349 A1 Jun. 25, 2020

Related U.S. Application Data

(60) Provisional application No. 62/783,611, filed on Dec. 21, 2018.

(51) Int. Cl.
*F21S 41/24* (2018.01)
*F21S 41/33* (2018.01)
*F21S 41/141* (2018.01)

(52) U.S. Cl.
CPC ..... *F21S 41/24* (2018.01); *F21S 41/338* (2018.01); *F21S 41/141* (2018.01)

(58) Field of Classification Search
CPC ..... B60Q 1/0011; B60Q 3/62; F21S 41/141; F21S 41/24; F21S 43/235–251
USPC ..... 362/511
See application file for complete search history.

(56) References Cited

U.S. PATENT DOCUMENTS

| | | | | |
|---|---|---|---|---|
| 4,949,226 | A | 8/1990 | Makita et al. | |
| 6,280,044 | B1 | 8/2001 | Kusakabe | |
| 6,896,397 | B2 | 5/2005 | Yamada et al. | |
| 7,111,970 | B2 | 9/2006 | Gasquet | |
| 7,229,197 | B2 | 6/2007 | Tanaka et al. | |
| 7,278,768 | B2 | 10/2007 | Gasquet | |
| 7,775,697 | B2 | 8/2010 | Hirano et al. | |
| 8,882,316 | B2 | 11/2014 | Natsume et al. | |
| 10,017,101 | B2 * | 7/2018 | Herbin | F21S 41/322 |
| 10,072,813 | B2 * | 9/2018 | Koizumi | F21S 43/241 |

(Continued)

FOREIGN PATENT DOCUMENTS

| | | | |
|---|---|---|---|
| JP | 04-039801 | A | 2/1992 |
| JP | 09-152360 | A | 6/1997 |

(Continued)

*Primary Examiner* — Jason M Han
(74) *Attorney, Agent, or Firm* — Dickinson Wright PLLC

(57) ABSTRACT

A light guide includes first and second input portions, first and second light emitting portions and a mixing portion. The mixing portion extends between the first input portion and the first light emitting portion, and between the second input portion and the second light emitting portion. Light generated by a first light source is guided from the first input portion toward the first light emitting portion, and light generated by a second light source is guided from the second input portion toward the second light emitting portion. The mixing portion is configured to receive light guided from the first input portion toward the first light emitting portion and configured to receive light guided from the second input portion toward the second light emitting portion.

27 Claims, 11 Drawing Sheets

(56) References Cited

U.S. PATENT DOCUMENTS

| | | | | |
|---|---|---|---|---|
| 10,371,341 | B2 * | 8/2019 | Hanami ..... | F21S 43/247 |
| 2003/0193815 | A1 | 10/2003 | Mishimagi | |
| 2004/0130904 | A1 | 7/2004 | Yamada et al. | |
| 2004/0136203 | A1 | 7/2004 | Gasquet | |
| 2007/0008736 | A1 | 1/2007 | Gasquet | |
| 2010/0008088 | A1 | 1/2010 | Koizumi et al. | |

FOREIGN PATENT DOCUMENTS

| | | | |
|---|---|---|---|
| JP | 2000-040412 | A | 2/2000 |
| JP | 2001-014921 | A | 1/2001 |
| JP | 2002-367403 | A | 12/2002 |
| JP | 2008-258037 | A | 10/2008 |
| JP | 2009-295552 | A | 12/2009 |

* cited by examiner

VEHICLE HEADLAMP HAVING LIGHT GUIDE

This patent application claims priority to U.S. Provisional Patent Application Ser. No. 62/783,611, filed Dec. 21, 2018, which is incorporated herein by reference in its entirety.

FIELD

The present disclosure relates to a vehicle headlamp having a light guide.

BACKGROUND

Some vehicles include a headlamp that may have one or more light pipes disposed therein. The one or more light pipes may conduct light generated via a light source (e.g., an LED) from a first end of the one or more light pipes toward a second end of the one or more light pipes. The light conducted from the first end of the one or more light pipes toward a second end of the one or more light pipes is emitted through the one or more light pipes and through the headlamp. The user may desire the one or more light pipes to include bends and twists, which presents issues with the one or more light pipes such as light losses as the light is conducted from the first end toward the second end of the light pipes, structural integrity, and lit appearance (e.g., dark spots that originate due to the spacing or gaps between the light pipes), for example. Furthermore, the light losses create difficulties, as each light pipe must provide a certain lumen minimum output to comply with regulatory standards (i.e., the amount of light emitted throughout the length of each light pipe must comply with certain regulatory standards). Thus, the present disclosure provides a light pipe that has structural robustness and is able to light up in between in order to create a harmonic light flow between input regions, thereby avoiding undesired light loss.

This section provides background information related to the present disclosure which is not necessarily prior art.

SUMMARY

This section provides a general summary of the disclosure, and is not a comprehensive disclosure of its full scope or all of its features.

In one form, the present disclosure provides a vehicle headlamp assembly having first and second light sources. The vehicle headlamp assembly further includes a base, an outer cover and a light guide. The base defines a cavity. The outer cover is attached to the base to enclose the cavity. The light guide is disposed within the cavity of the base and includes first and second input portions, first and second light emitting portions and a mixing portion. The first and second elongated light emitting portions diverge from each other. The mixing portion extends between the first input portion and the first light emitting portion, and between the second input portion and the second light emitting portion. Light generated by the first light source is guided from a first end of the first input portion toward a second end of the first light emitting portion, and light generated by the second light source is guided from a third end of the second input portion toward a fourth end of the second light emitting portion. The mixing portion is configured to receive light guided from the first end of the first input portion toward the second end of the first light emitting portion and configured to receive light guided from the third end of the second input portion toward the fourth end of the second light emitting portion. The mixing portion configured to emit the received light toward the outer cover.

In some configurations of the vehicle headlamp assembly of the above paragraph, the mixing portion has first and second opposing sides. The first side is a concave shape and faces the first and third ends of the first and second input portions, respectively.

In some configurations of the vehicle headlamp assembly of one or more of the above paragraphs, the second side is a convex shape.

In some configurations of the vehicle headlamp assembly of one or more of the above paragraphs, first reflectors are disposed along the first input portion, the mixing portion and the first light emitting portion. Second reflectors are disposed along the second light emitting portion and the mixing portion.

In some configurations of the vehicle headlamp assembly of one or more of the above paragraphs, a portion of light guided from the first end of the first input portion toward the second end of the first light emitting portion is reflected into the mixing portion via the first reflectors and a portion of the light guided from the third end of the second input portion toward the fourth end of the second light emitting portion is reflected into the mixing portion via the second reflectors.

In some configurations of the vehicle headlamp assembly of one or more of the above paragraphs, the light that is reflected into the mixing portion is emitted through the second side of the mixing portion.

In some configurations of the vehicle headlamp assembly of one or more of the above paragraphs, the mixing portion has a thickness of 3 mm.

In some configurations of the vehicle headlamp assembly of one or more of the above paragraphs, the first and second input portions, the first and second light emitting portions and the mixing portion are made of a polycarbonate transparent material.

In another form, the present disclosure provides a light guide. The light guide may include a first light source, a second light source, first and second input portions, first and second light emitting portions and a mixing portion. The first and second elongated light emitting portions diverge from each other. The mixing portion extends between the first input portion and the first light emitting portion, and between the second input portion and the second light emitting portion. Light generated by the first light source is guided from a first end of the first input portion toward a second end of the first light emitting portion, and light generated by the second light source is guided from a third end of the second input portion toward a fourth end of the second light emitting portion. The mixing portion is configured to receive light guided from the first end of the first input portion toward the second end of the first light emitting portion and configured to receive light guided from the third end of the second input portion toward the fourth end of the second light emitting portion.

In some configurations of the light guide of the above paragraph, the mixing portion has first and second opposing sides. The first side is a concave shape and faces the first and third ends of the first and second input portions, respectively.

In some configurations of the light guide of one or more of the above paragraphs, the second side is a convex shape.

In some configurations of the light guide of one or more of the above paragraphs, first reflectors are disposed along the first input portion, the mixing portion and the first light emitting portion. Second reflectors are disposed along the second light emitting portion and the mixing portion.

In some configurations of the light guide of one or more of the above paragraphs, a portion of light guided from the first end of the first input portion toward the second end of the first light emitting portion is reflected into the mixing portion via the first reflectors and a portion of the light guided from the third end of the second input portion toward the fourth end of the second light emitting portion is reflected into the mixing portion via the second reflectors.

In some configurations of the light guide of one or more of the above paragraphs, light reflected into the mixing portion is emitted through the second side of the mixing portion.

In some configurations of the light guide of one or more of the above paragraphs, the mixing portion has a thickness of 3 mm.

In some configurations of the light guide of one or more of the above paragraphs, the first and second input portions, the first and second light emitting portions and the mixing portion are made of a polycarbonate transparent material.

In yet another form, the present disclosure provides a vehicle headlamp assembly having first and second light sources. The vehicle headlamp assembly also includes a base, an outer cover and a light guide. The base defines a cavity. The outer cover is attached to the base to enclose the cavity. The light guide is disposed within the cavity of the base and includes first and second input portions, first and second light emitting portions and a mixing portion. The first and second input portions extend substantially parallel to each other. The first elongated light emitting portion diverges from the second input portion and the second light emitting portion. The second elongated light emitting portion diverges from the first input portion and the first light emitting portion. The mixing portion extends between the first input portion and the first light emitting portion, and between the second input portion and the second light emitting portion. Light generated by the first light source is guided from a first end of the first input portion toward a second end of the first light emitting portion, and light generated by the second light source is guided from a third end of the second input portion toward a fourth end of the second light emitting portion.

In some configurations of the headlamp assembly of the above paragraph, the mixing portion is configured to receive light guided from the first end of the first input portion toward the second end of the first light emitting portion and configured to receive light guided from the third end of the second input portion toward the fourth end of the second light emitting portion, the mixing portion is configured to emit the received light toward the outer cover.

In some configurations of the headlamp assembly of one or more of the above paragraphs, the mixing portion has a thickness between 2.5 mm and 3 mm.

In some configurations of the headlamp assembly of one or more of the above paragraphs, the first and second input portions, the first and second light emitting portions and the mixing portion are made of a polycarbonate transparent material.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 11 is a close-up view of a portion of the light guide showing the light being guided through.

Corresponding reference numerals indicate corresponding parts throughout the several views of the drawings.

DETAILED DESCRIPTION

Example embodiments will now be described more fully with reference to the accompanying drawings.

Figure 1:
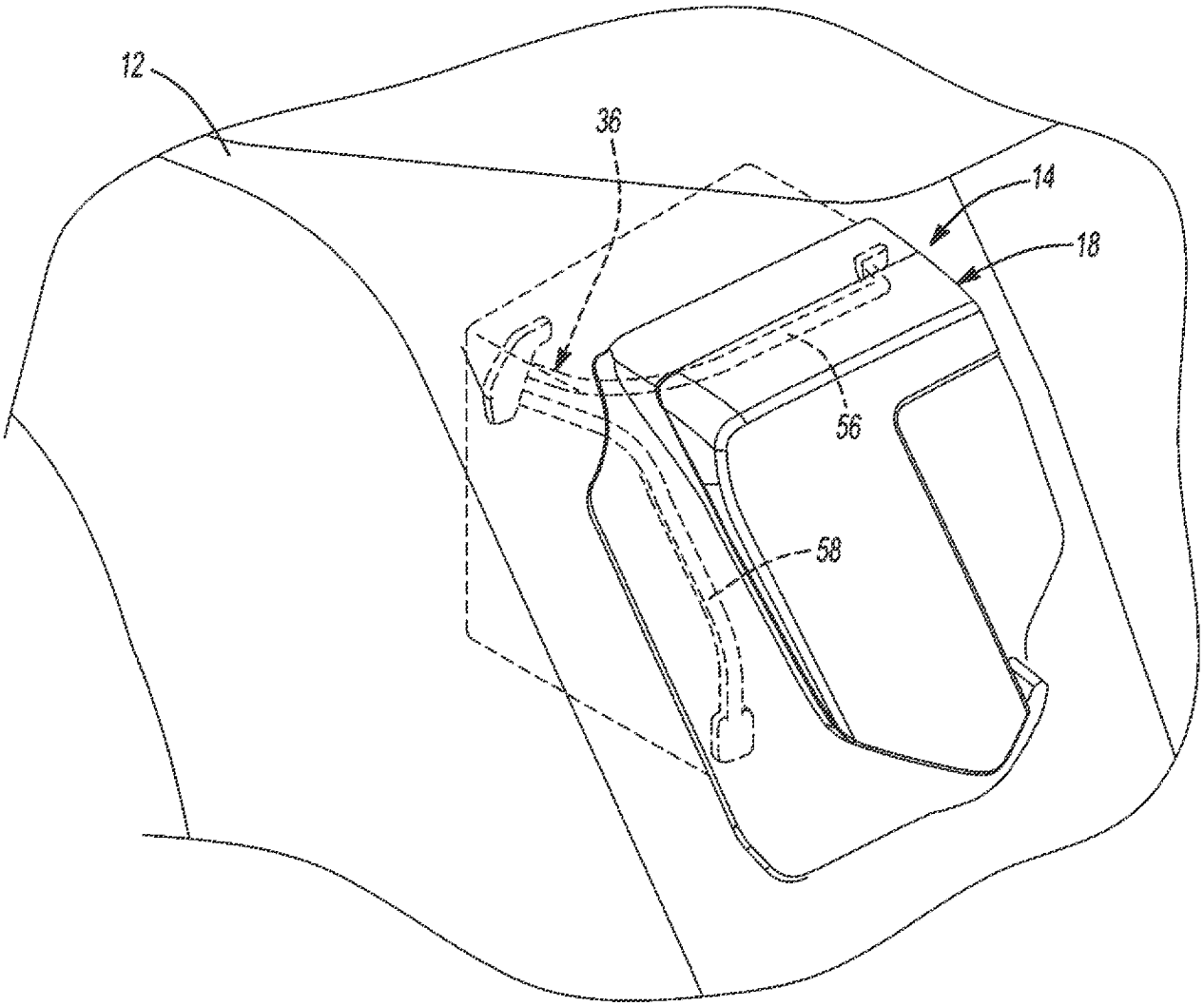
FIG. 1 is a perspective view of a portion of a vehicle having a headlamp assembly according to the principles of the present disclosure.
Figure 2:
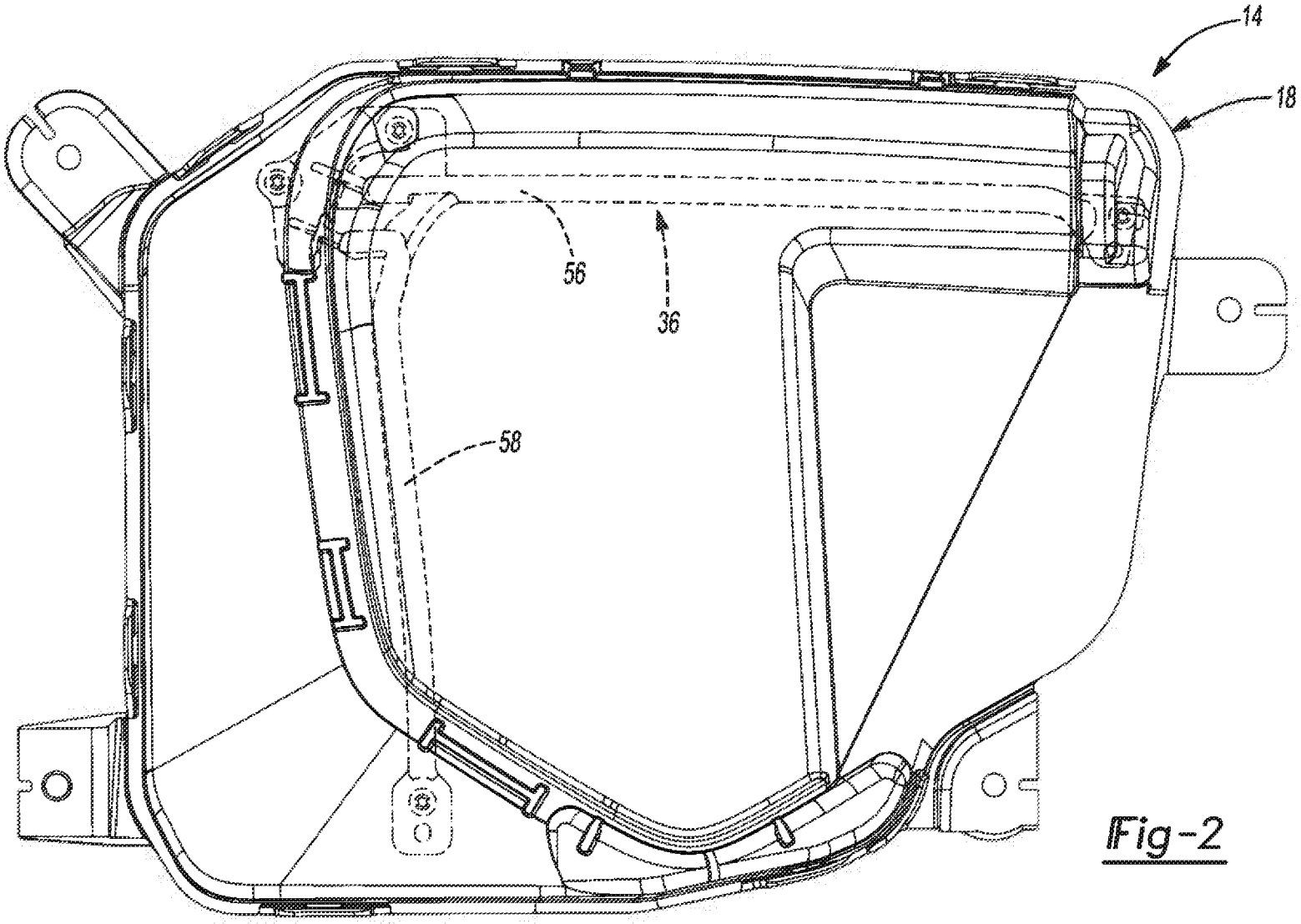
FIG. 2 is a front view of the headlamp assembly of FIG. 1.

With reference to FIG. 1, a vehicle may include a vehicle body 12 that defines lamp wells (not shown) at a front end of the vehicle body 12. With reference to FIGS. 1-4, a headlamp assembly 14 may be disposed in a respective lamp well (not shown) and may include a base 16, an outer transparent lens cover 18 and a lamp unit 20. The base 16 may define a cavity 22 and may also be attached to the vehicle body 12 via a plurality of fasteners (not shown). The outer cover 18 may be transparent and may be attached to the base 16 so as to enclosed the cavity 22 defined by the base 16. In some configurations, the outer cover 18 may be attached to the lamp unit 20.

The lamp unit 20 may be disposed between the base 16 and the outer cover 18 and within the enclosed cavity 22. The lamp unit 20 may also be attached to the base 16 via a plurality of fasteners (e.g., snap fasteners, mounting tabs, threaded bolt cavities, etc.). In some configurations, the lamp unit 20 may be attached to the outer cover 18. The lamp unit 20 may include a lamp housing or bezel 24 and a light guide apparatus 26.

Figure 5:
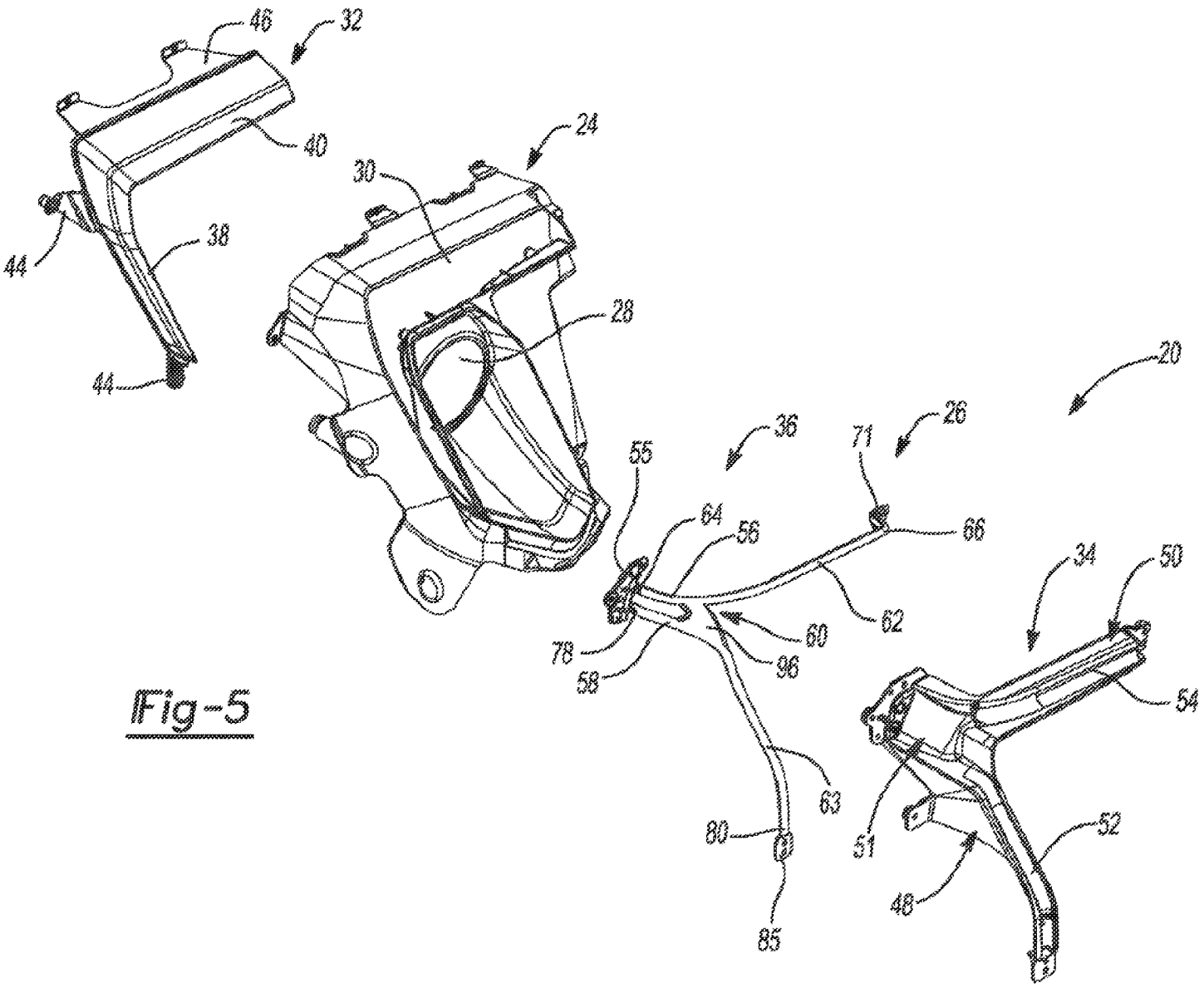
FIG. 5 is an exploded view of a lamp unit of the headlamp assembly.
Figure 6:
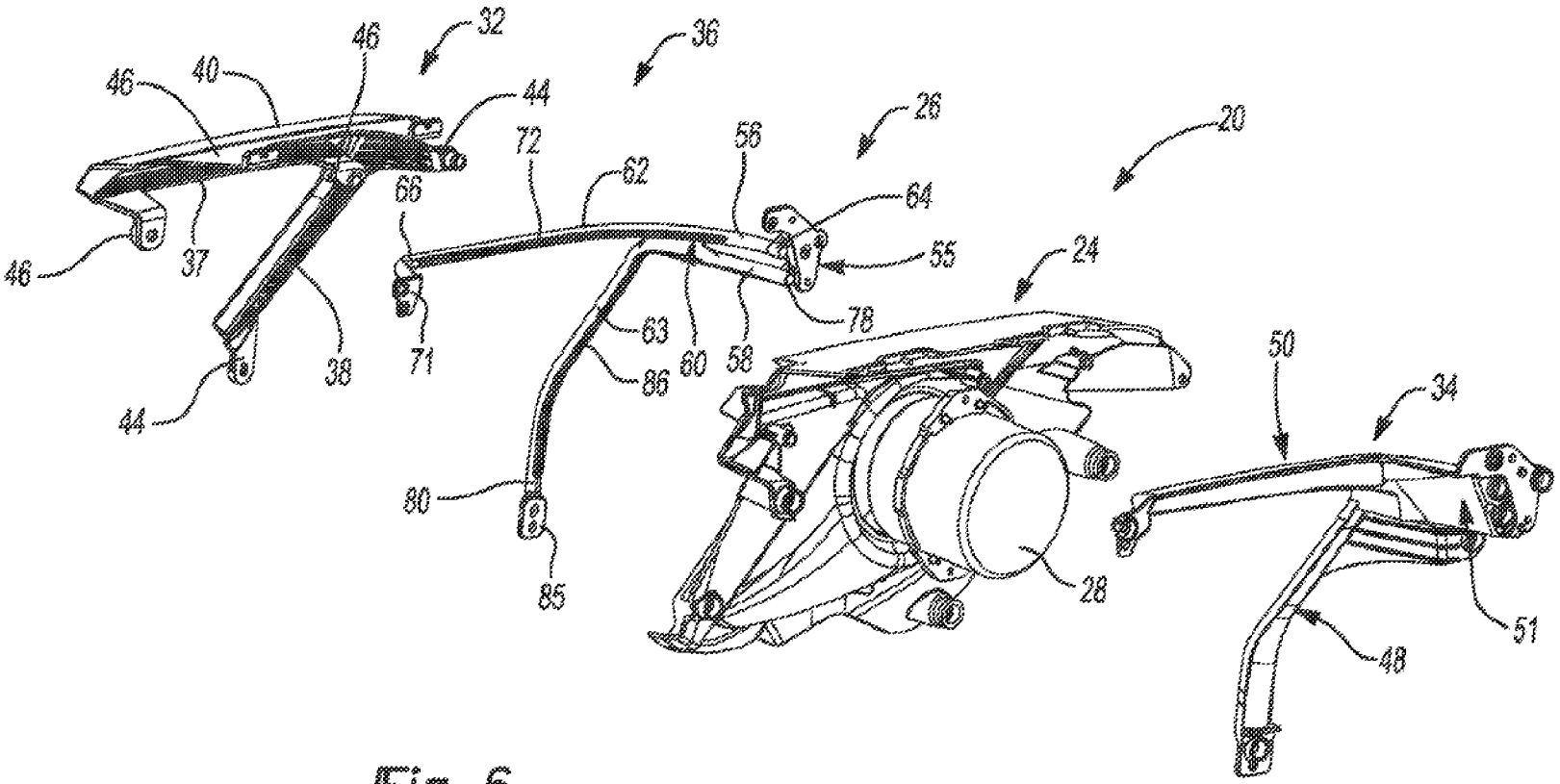
FIG. 6 is another exploded view of the lamp unit of the head lamp assembly.

The lamp housing 24 may be attached to the base 16 via the plurality of fasteners (e.g., snap fasteners, mounting tabs, threaded bolts, etc.) and may include a headlight 28 (FIGS. 3, 5 and 6) that is configured to emit light through the outer cover 18. As shown in FIG. 5, the lamp housing 24 may also define a generally L-shaped opening 30. The light guide apparatus 26 may be disposed in the opening 30 defined in the lamp housing 24. As shown in FIGS. 5 and 6, the light guide apparatus 26 may include a first cover or inner lens 32, a second cover or carrier fixture 34 and a light guide 36.

Figure 3:
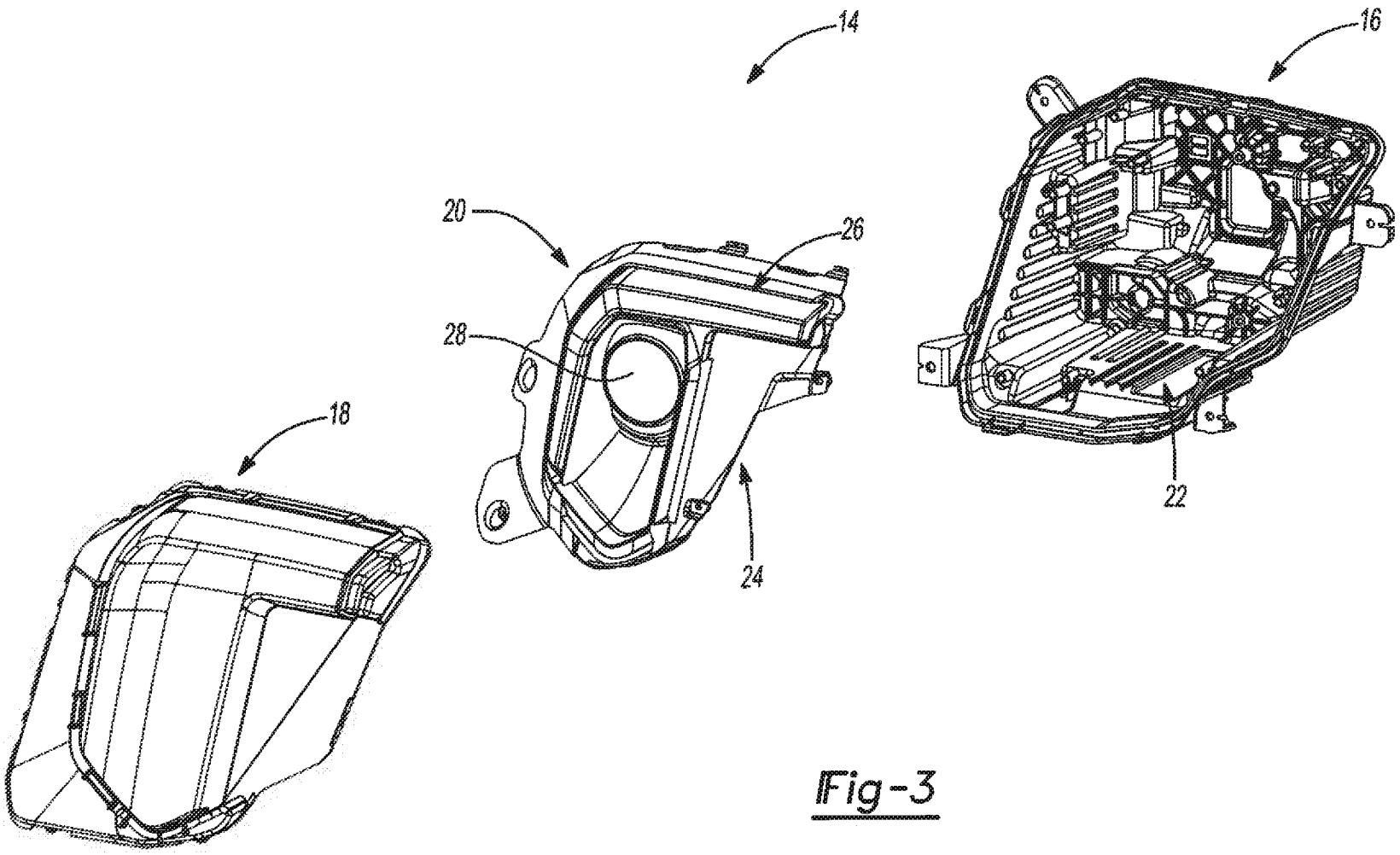
FIG. 3 is an exploded view of the headlamp assembly.

The first cover 32 may be generally L-shaped and made of a polymeric material. The first cover 32 covers the light guide 36 and helps to distribute light emitted from the light guide 36 towards the front of the headlamp assembly 14. In one embodiment, the first cover 32 may be made of a clear polymeric material such that it does not diffuse light emitted from the light guide 36. In another embodiment, the first cover 32 may be made of a material such that light emitted from the first cover 32 is diffused. In an example embodiment, the first cover 32 may be attached to the lamp housing 24. With reference to FIGS. 3, 5 and 6, the first cover 32 may also define a cavity 37 (FIG. 6) and may include a vertical section 38 and a horizontal section 40. The vertical section 38 may extend downwardly from an end of the horizontal section 40 and may include mounting brackets 44 extending therefrom. A plurality of fasteners (not shown) may extend through apertures in the mounting brackets 44, thereby attaching the first cover 32 to the lamp housing 24. The horizontal section 40 may include mounting brackets 46 extending therefrom. A plurality of fasteners (not shown) may extend through apertures in the mounting brackets 46, thereby further attaching the first cover 32 to the lamp housing 24.

The second cover 34 may be generally L-shaped and may correspond to the geometry of the light guide 36. The second cover 34 may be made of a polymeric material and may be coated with a chrome-type coating, for example, in order to help distribute light emitted from the light guide 36 towards the front of the headlamp assembly 14. In an example embodiment, the second cover 34 may be attached to the lamp housing 24 and the light guide 36. The second cover 34 may cooperate with the first cover 32 so as to enclose the cavity 37 defined by the first cover 32. The second cover 34 may include a vertical section 48, a horizontal section 50 and a mixing section 51. The vertical section 48 may be curved and may extend downwardly from the mixing section 51. The vertical section 48 may define a recess 52 that corresponds to the shape of the light guide 36. The horizontal section 50 may be curved and may extend horizontally from an end of the mixing section 51. The horizontal section 50 may define a recess 54 that corresponds to the shape of the light guide 36.

The light guide 36 may be disposed in the enclosed cavity 37 formed by the first cover 32 and the second cover 34. The light guide 36 may also be attached to the second cover 34 via a plurality of fasteners (not shown).

The light guide 36 may be made of a polymeric or acrylic clear material, for example, and may be manufactured by injection molding, for example (such that the light guide 36 is a unitary part). This reduces manufacturing cost of the light guide 36 by simplifying the manufacturing process. This reduces manufacturing cost of the light guide 36 by simplifying the manufacturing process.

The light guide 36 may include a bracket 55, first and second input portions 56, 58, a mixing portion 60 and first and second light emitting portions 62, 63. The bracket 55 may be attached to the second cover 34 via the plurality of fasteners (not shown) and may extend from the first and second input portions 56, 58. The first and second input portions 56, 58, a mixing portion 60 and first and second light emitting portions 62, 63 of the light guide 36 can be configured as a unitary part. The first and second input portions 56, 58, mixing portion 60 and first and second light emitting portions 62, 63 of the light guide 36 have cavities therein along which light from a light source (e.g., LED module) can be guided through the first and second input portions 56, 58 and mixing portion 60 and toward respective ends of the first and second light emitting portions 62, 63, as described below.

The first input portion 56 may be disposed at least partially in the mixing section 51 and may have a cylindrical-shape. The first input portion 56 may have a diameter of approximately 10 mm. The first input portion 56 may extend parallel to the second input portion 58 and may have an end 64 that extends from the bracket 55 (via an attachment member 69).

The second input portion 58 may be disposed at least partially in the mixing section 51 and may have a cylindrical-shape. The second input portion 58 may have a diameter of approximately 10 mm. The second input portion 58 may have an end 78 that extends from the bracket 55 (via an attachment member 83).

The mixing portion 60 may be disposed in the mixing section 51 of the second cover 34. As shown in FIGS. 5-10, the mixing portion 60 may be positioned between the first input portion 56 and the first light emitting portion 62, and may be positioned between the second input section 58 and the second light emitting portion 63.

In one example, the mixing portion 60 may have a thickness between 2.5 mm to 3 mm.

Figure 7:
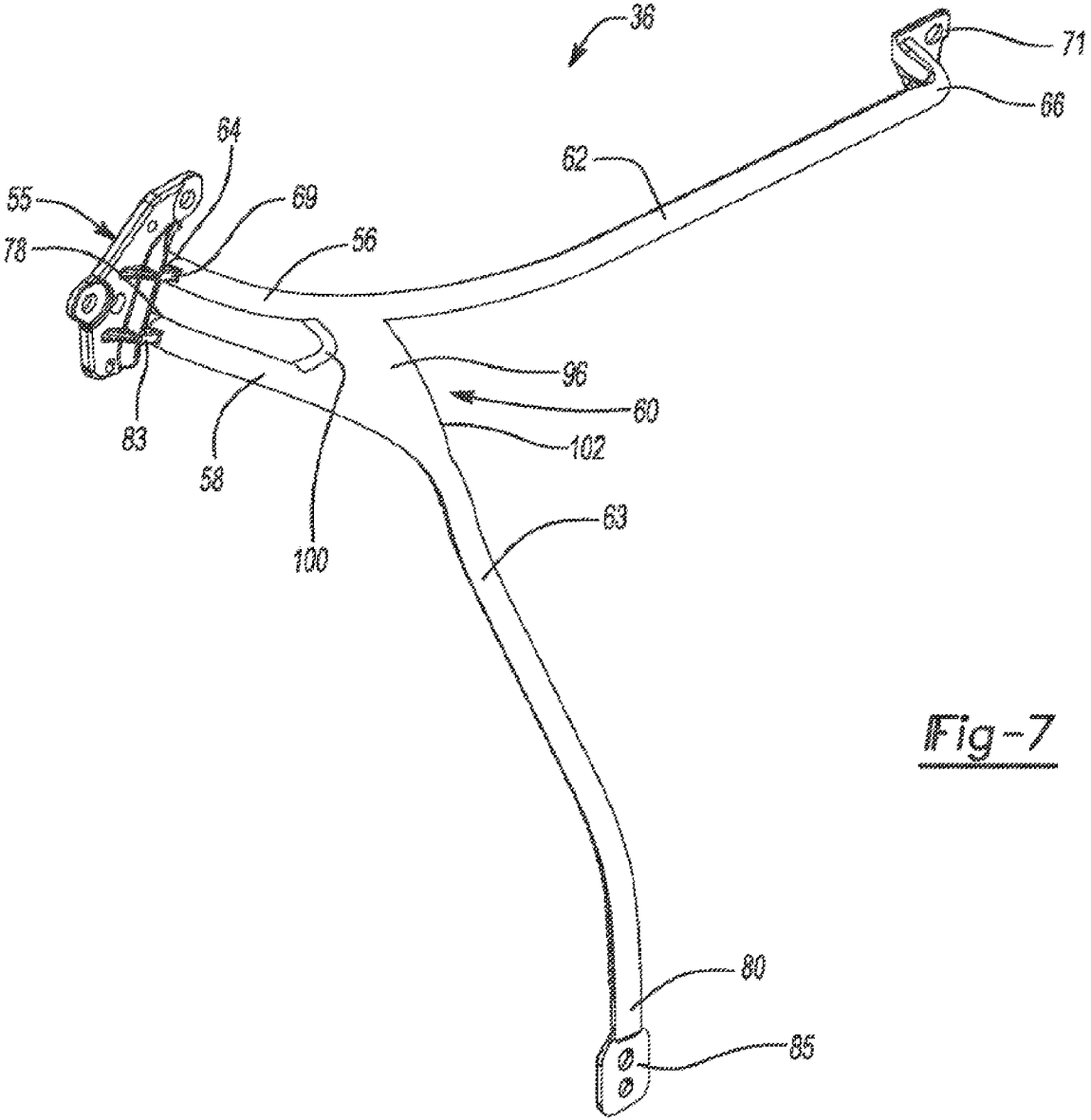
FIG. 7 is a perspective view of a light guide of the lamp unit.
Figure 8:
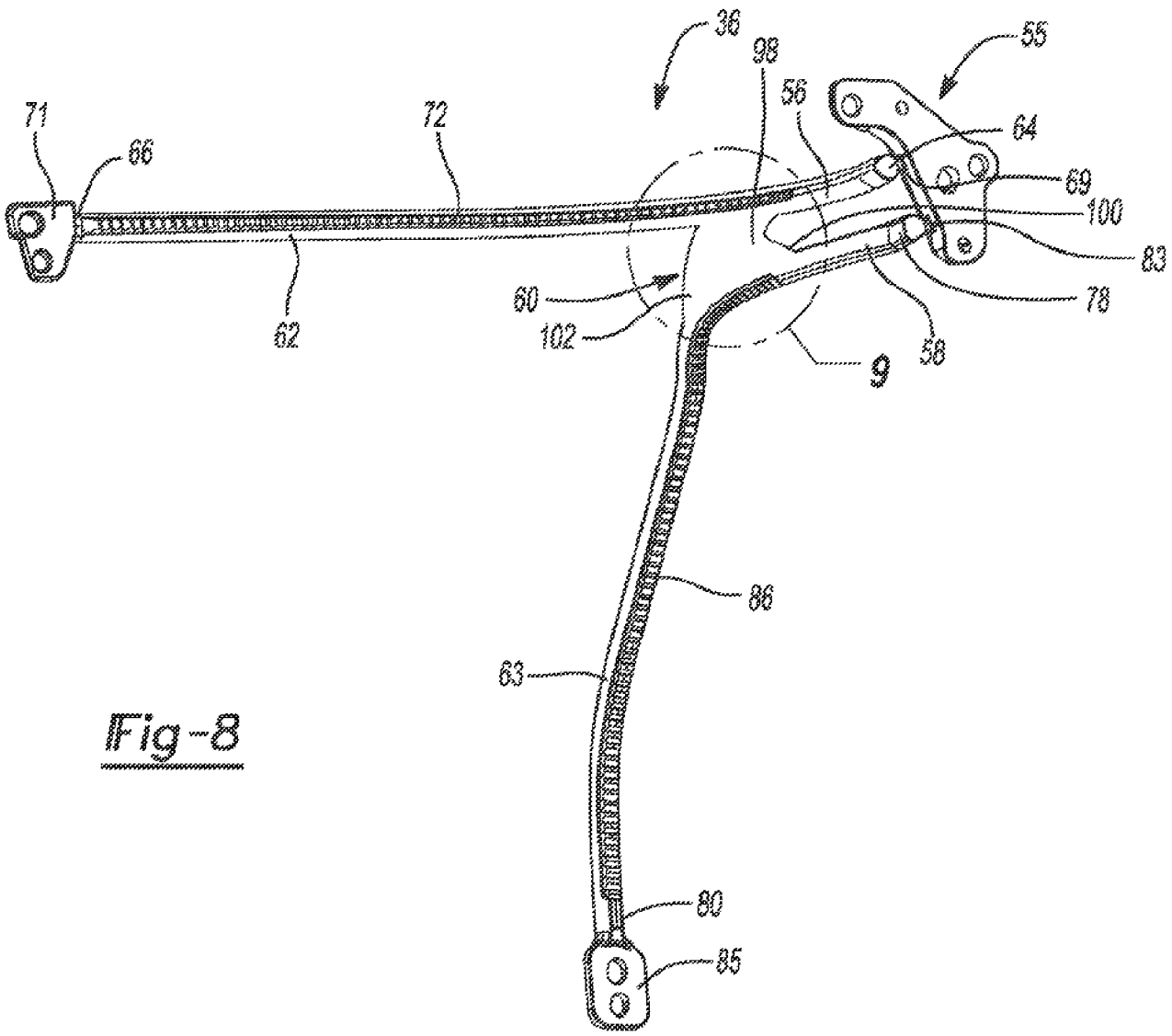
FIG. 8 is another perspective view of the light guide of the lamp unit.
Figure 9:
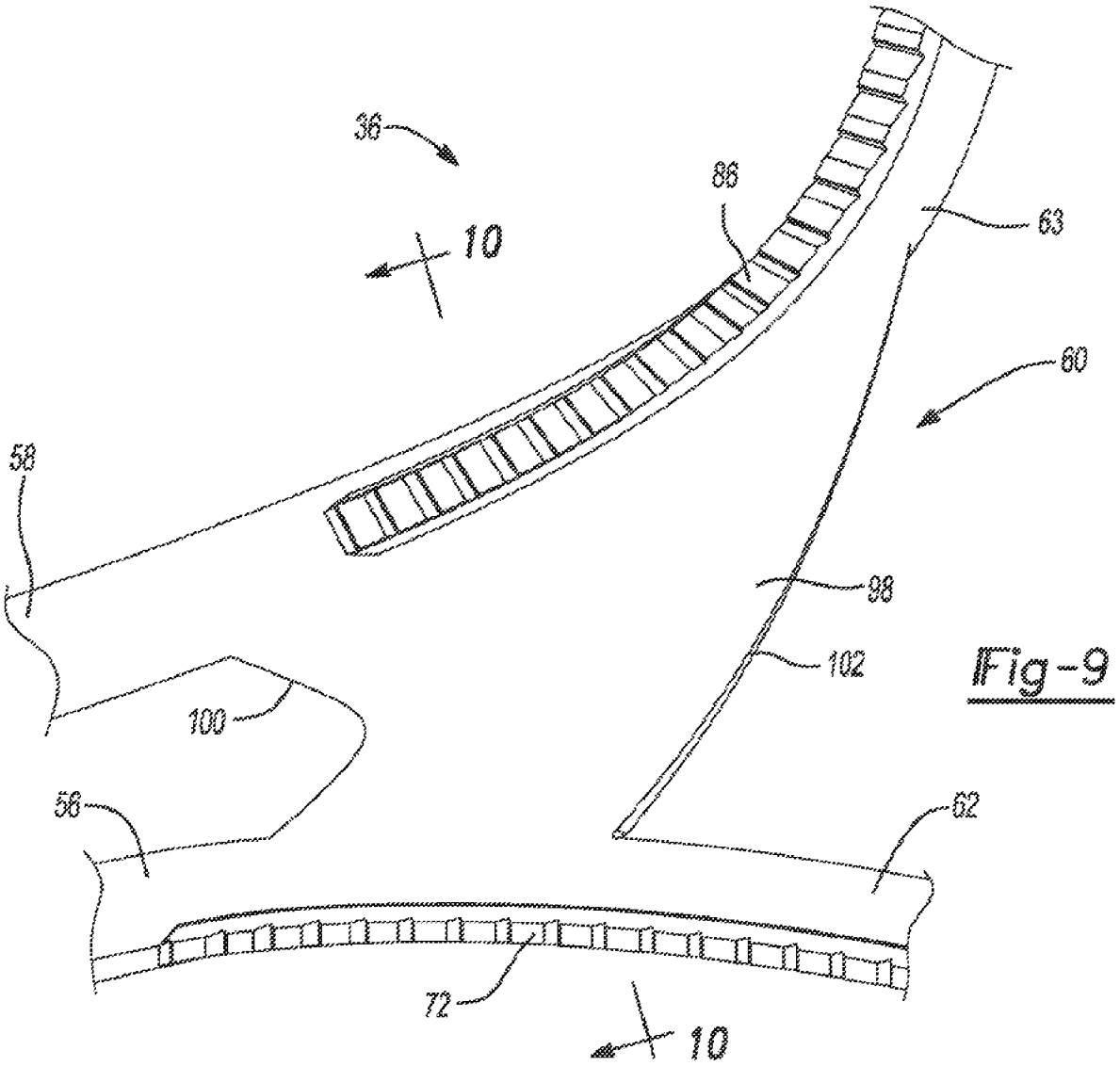
FIG. 9 is a close-up view of a portion of the light guide indicated as area 9 in FIG. 8.
Figure 10:
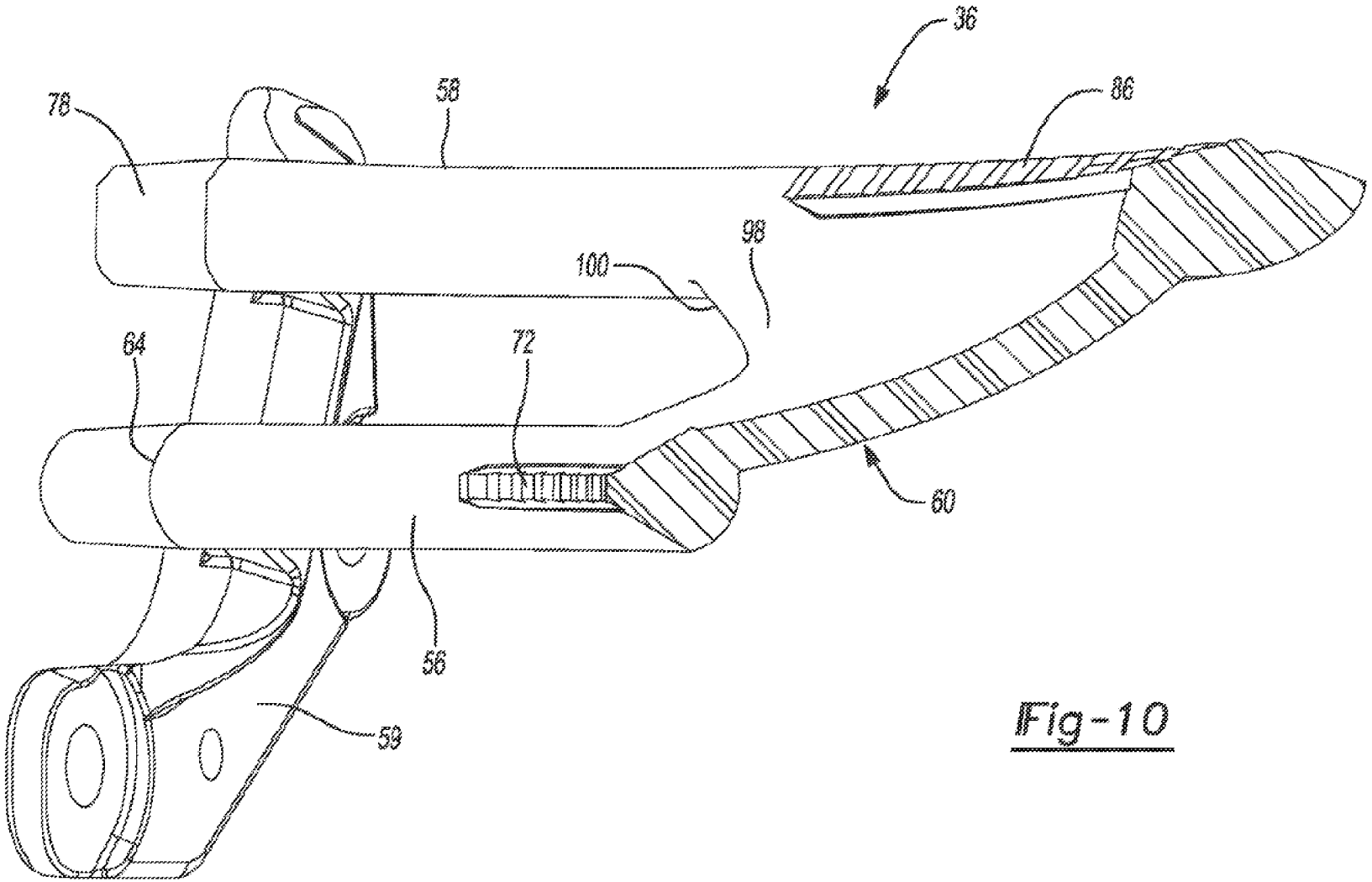
FIG. 10 is a cross-sectional view of the light guide taken along line 10-10 of FIG. 9.

With reference to FIGS. 5-10, the mixing portion 60 may include a top surface 96 (FIGS. 5 and 7), a bottom surface 98 (FIGS. 8-10), a back side 100 (FIGS. 7-10) and a front side 102 (FIGS. 7-9). The back side 100 may be a concave shape and may face the ends 64, 78 of the first and second input portions 56, 58, respectively. The front side 102 may be a convex-shape and may face opposite the ends 64, 78 of the first and second input portions 56, 58, respectively.

The first light emitting portion 62 may be disposed in the recess 54 of the horizontal section 50 of the second cover 34. The first light emitting portion 62 may have an elongated cylindrical-shape and may be curved. In one example, the first light emitting portion 62 may have a diameter of approximately 10 mm. As shown in FIG. 7, the first light emitting portion 62 may diverge from the second input portion 58 and the second light emitting portion 63 as the first light emitting portion 62 extends from the mixing portion 60. When viewing the first light emitting portion 62 from the front of the vehicle, the first light emitting portion 62 may extend along a top of the headlamp assembly 14. It is understood that the first light emitting portion 62 may extend along different areas of the headlamp assembly 14 other than along the top of the headlamp assembly 14.

Figure 4:
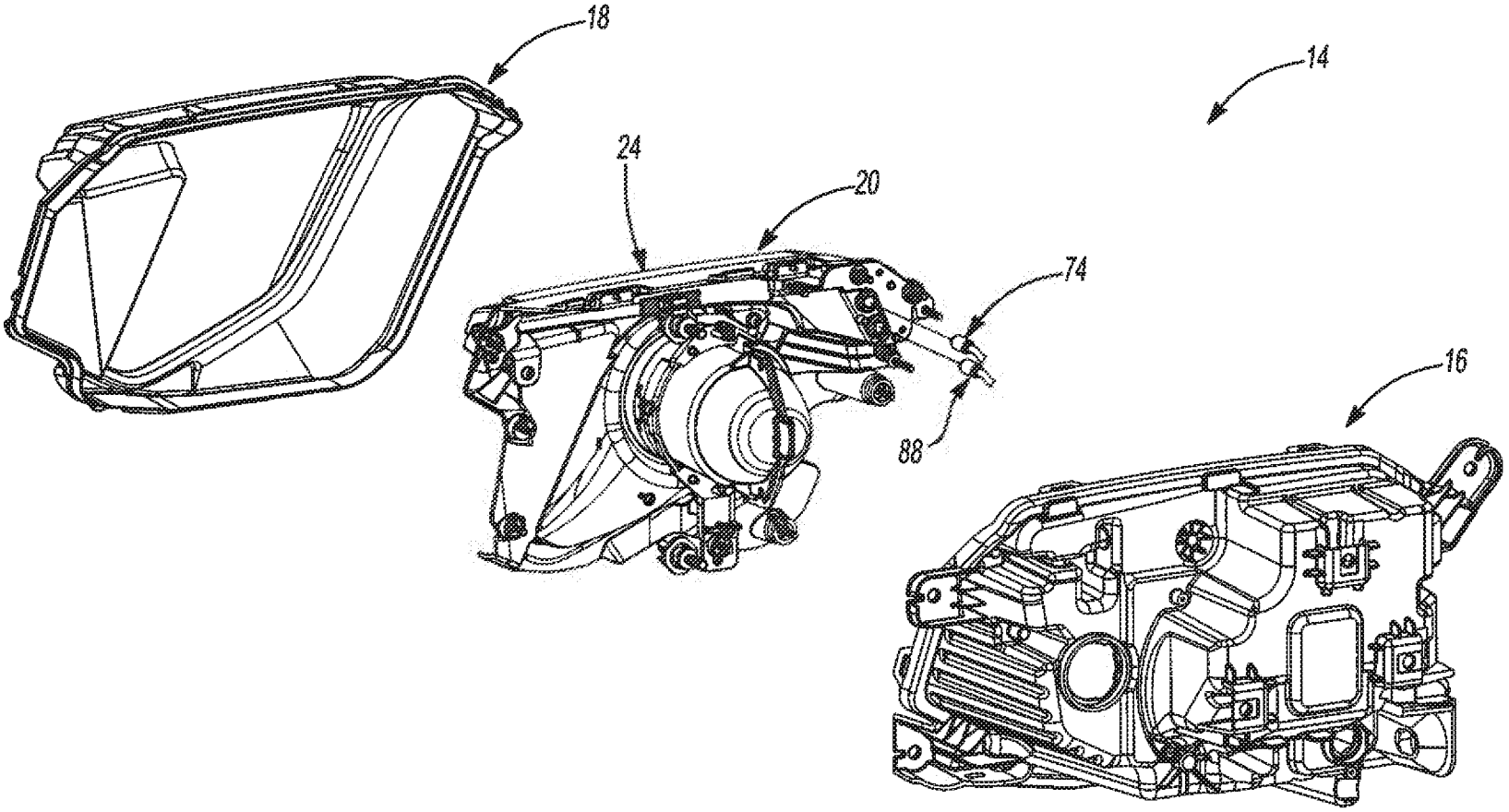
FIG. 4 is another exploded view of the headlamp assembly.
Figure 11:
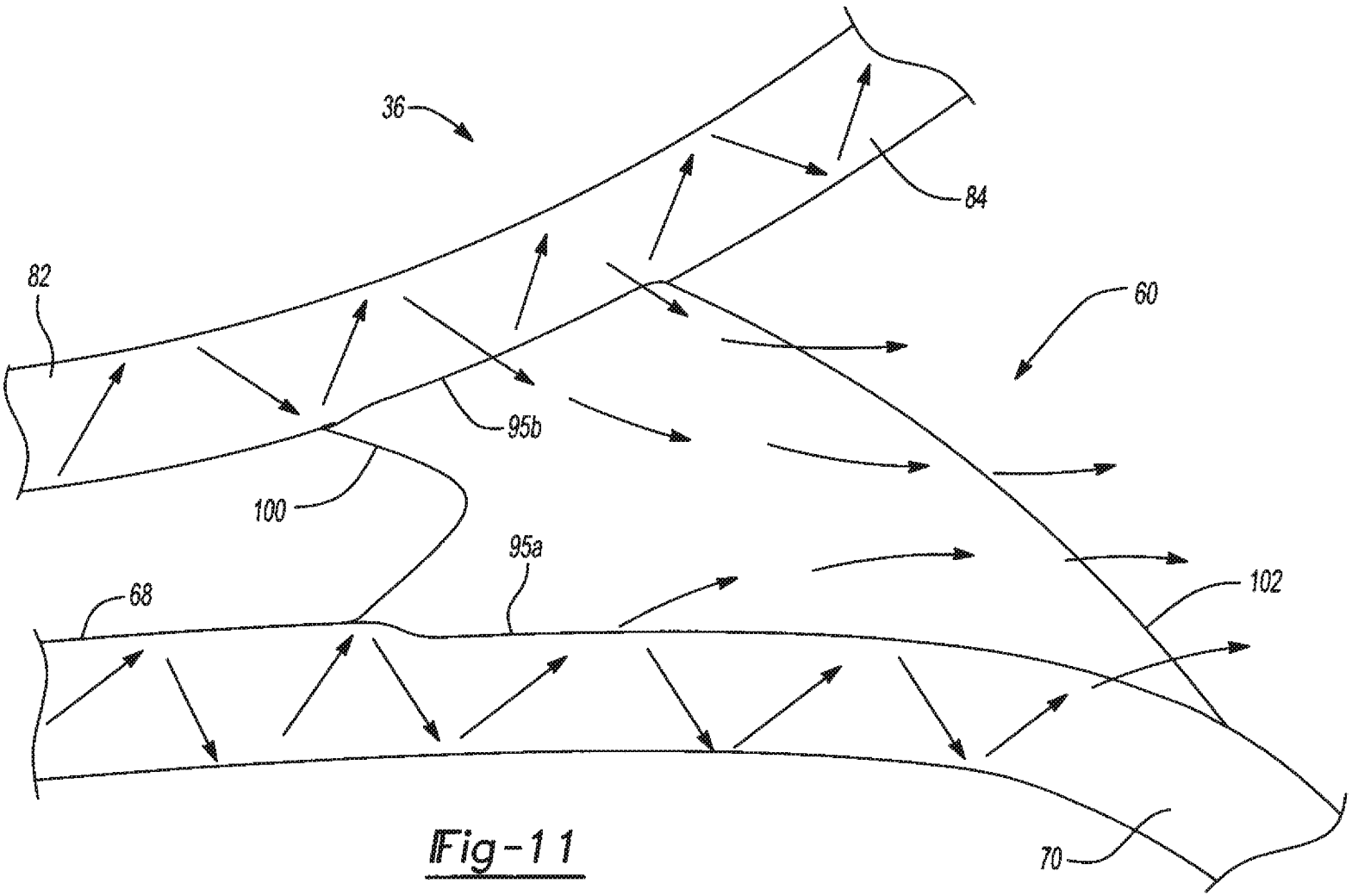

As shown in FIGS. 6 and 8-10, reflectors 72 may extend along a back side of the first light emitting portion 62, a first side of the mixing portion 60 and partially along a back side of the first input portion 56. In one example, the reflectors 72 may be prisms that are formed in surfaces of the first light emitting portion 62, the mixing portion 60 and the first input portion 56. With reference to FIG. 4, a light source 74 (e.g., LED module) may be mounted to the lamp unit 20 and may house a printed circuit board (PCB; not shown). The light source 74 may include an electrical terminal (not shown) that may be operatively connected to an electrical connector from a wiring harness to provide electrical communication between the light source 74 and the vehicle. Light generated by the light source 74 is transmitted (or guided) from the end 64 of the first input portion 56 through the mixing portion 60 and toward an end 66 of the first light emitting portion 62 that is attached to the second cover 34 via an attachment bracket 71 and the plurality of fasteners (not shown). Light transmitted along a length of the first light emitting portion 62 is emitted through a surface (a surface facing the outer cover 18) thereof and toward the outer cover 18. Stated another way, light generated by the light source 74 is guided via the reflectors 72 from the end 64 of the first input portion 56 toward the end 66 of the first light emitting portion 62 where light is emitted through the surface of the first light emitting portion 62 and toward the outer cover 18. As shown in FIG. 11, at least a portion of the light transmitted from the end 64 of the first input portion 56 toward the end 66 of the first light emitting portion 62 is reflected (via the reflectors 72) into the mixing portion 60 where the light is emitted out of the front side 102.

The second light emitting portion 63 may be disposed in the recess 52 of the vertical section 48 of the second cover 34. The second light emitting portion 63 may have an elongated cylindrical-shape and may be curved. In one example, the second light emitting portion 63 may have a diameter of approximately 10 mm. As shown in FIG. 7, the second light emitting portion 63 may diverge from the first input portion 56 and the first light emitting portion 62 as the second light emitting portion 63 extends from the mixing portion 60. When viewing the second light emitting portion 63 from the front of the vehicle, the second light emitting portion 63 may extend along a side and/or bottom of the headlamp assembly 14. It is understood that the second light emitting portion 63 may extend along different areas of the headlamp assembly 14 other than along the side and/or the bottom of the headlamp assembly 14.

As shown in FIGS. 6 and 8-10, reflectors 86 may extend along a back side of the second light emitting portion 63 and a second side of the mixing portion 60. In some configurations, the reflectors 86 may also partially extend along a back side of the second input portion 58. In one example, the reflectors 86 may be prisms that are formed in the surfaces of the second light emitting portion 63 and the mixing portion 60. With reference to FIG. 4, a light source 88 (e.g., LED module) may be mounted to the lamp unit 20 and may house a printed circuit board (PCB; not shown). The light source 88 may include an electrical terminal (not shown) that may be operatively connected to an electrical connector from a wiring harness to provide electrical communication between the light source 88 and the vehicle. Light generated by the light source 88 is transmitted (or guided) from the end 78 of the second input portion 58 through the mixing portion 60 and toward an end 80 of the second light emitting portion 63 that is attached to the second cover 34 via an attachment bracket 85 and the plurality of fasteners (not shown). Light transmitted along a length of the second light emitting portion 63 is emitted through a surface (a surface facing the outer cover 18) thereof and toward the outer cover 18. Stated another way, light generated by the light source 88 is guided via the reflectors 86 from the end 78 of the second input portion 58 toward the end 80 of the second light emitting portion 63 where light is emitted through the surface of the second light emitting portion 63 and toward the outer cover 18. As shown in FIG. 11, at least a portion of the light transmitted from the end 78 of the second input portion 58 toward the end 80 of the second light emitting portion 63 is reflected (via the reflectors 86) into the mixing portion 60 where the light is emitted out of the front side 102.

With reference to FIGS. 1-11, operation of the light guide 36 will be described in detail. As light from the light source 74 is guided (via the reflectors 72) from the end 64 of the first input portion 56 toward the end 66 of the first light emitting portion 62 where light is emitted through the surface of the first light emitting portion 62 and toward the outer cover 18, at least a portion of the light transmitted from the end 64 of the first input portion 56 toward the end 66 of the first light emitting portion 62 is reflected (via the reflectors 72) into the mixing portion 60. Similarly, as light from the light source 88 is guided (via the reflectors 86) from the end 78 of the second input portion 58 toward the end 80 of the second light emitting portion 63 where light is emitted through the surface of the second light emitting portion 63 and toward the outer cover 18, at least a portion of the light transmitted from the end 78 of the second input portion 58 toward the end 80 of the second light emitting portion 63 is reflected (via the reflectors 86) into the mixing portion 60. As shown in FIG. 11, light in the mixing portion 60 mixes and is emitted out of the front side 102. In some configurations, light in the mixing portion 60 may reflect off of the back side 100 where light may be directed and emitted through the front side 102. In this way, light emitted through the mixing portion 60 and the first and second light emitting portions 62, 63 reduces the darks spots (i.e., gaps or spaces) originating from the separation of the first and second input portions 56, 58 and separation of the first and second light emitting portions 62, 63, thereby creating a harmonic and continuous light flow.

One of the benefits of the light guide 36 of the present disclosure is that the mixing portion 60 provides structural robustness to the diverging first and second light emitting portions 62, 63. Another benefit of the light guide 36 is that the mixing portion 60 emits light, therefore, reducing the dark spots (i.e., gaps or spaces) originating from the separation of the first and second input portions 56, 58 and separation of the first and second light emitting portions 62, 63, thereby creating a harmonic and continuous light flow.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A vehicle headlamp assembly having first and second light sources, the vehicle headlamp assembly comprising:

a base defining a cavity;

an outer cover attached to the base to enclose the cavity; and a light guide disposed within the cavity of the base, the light guide comprising:

first and second input portions;

first and second elongated light emitting portions each having a cylindrical-shaped cross-section, the first and second light emitting portions diverging from each other;

a mixing portion extending between the first input portion and the first light emitting portion, and between the second input portion and the second light emitting portion, the mixing portion comprising a top surface, an opposite facing bottom surface, a back side facing toward the first and second input portions, a front side facing toward the outer cover in an area between the diverging first and second light emitting portions, a first side disposed along at least a part of the first input portion and a part of the first light emitting portion, and a second side disposed along at least a part of the second input portion and a part of the second light emitting portion; and first reflectors disposed along at least part of the first side of the mixing portion and along at least a part of the first light emitting portion, and second reflectors disposed along at least part of the second side of the mixing portion and along at least part of the second light emitting portion;

wherein light generated by the first light source is guided from a first end of the first input portion toward a second end of the first light emitting portion and parallel to the outer cover, and light generated by the second light source is guided from a third end of the second input portion toward a fourth end of the second light emitting portion and parallel to the outer cover, wherein a portion of light guided from the first end to the first input portion toward the second end of the first light emitting portion is reflected into the mixing portion via the first reflectors and a portion of the light guided from the third end of the second input portion toward the fourth end of the second light emitting portion is reflected into the mixing portion via the second reflectors, the mixing portion is configured to receive light guided from the first end of the first input portion toward the second end of the first light emitting portion and configured to receive light guided from the third end of the second input portion toward the fourth end of the second light emitting portion, the mixing portion configured to emit the received light toward the outer cover, and wherein the first and second light emitting portions each emit its guided light along at least a portion of its length and toward the outer cover, and wherein the front side of the mixing portion is a convex shape that emits light received in the mixing portion toward the outer cover in the area between the diverging first and second light emitting portions.

2. The vehicle headlamp assembly of claim 1, wherein the first side and the second side of the mixing portion are opposing sides, and wherein the back side is disposed adjacent to the first and second input portions and has a concave shape that faces the first and third ends of the first and second input portions, respectively, and the front side extends between the diverging first and second light emitting portions.

3. The vehicle headlamp assembly of claim 1, wherein the first reflectors are disposed along a portion of the light guide chosen from the first input portion, the mixing portion and the first light emitting portion, and wherein the second reflectors are disposed along a portion of the light guide chosen from the second light emitting portion and the mixing portion, the first and second reflectors disposed along a back side of the light guide that is opposite a surface of the light guide that emits the guided light toward the outer cover.

4. The vehicle headlamp assembly of claim 3, wherein the mixing portion has opposing first and second sides, and wherein the back side is disposed adjacent to the first and second input portions and has a concave shape that faces the first and third ends of the first and second input portions, respectively, and the front side extends between the diverging first and second light emitting portions.

5. The vehicle headlamp assembly of claim 1, wherein the mixing portion has a thickness between 2.5 mm and 3 mm.

6. The vehicle headlamp assembly of claim 1, wherein the first and second input portions, the first and second light emitting portions and the mixing portion are made of a polycarbonate transparent material.

7. The vehicle headlamp assembly of claim 1, wherein the first side and second input portions are parallel to each other and spaced apart, and the back side extends between the first side and second input portions.

8. The vehicle headlamp assembly of claim 1, wherein the diameter of any of the first side and second input portions and the first and second elongated light emitting portions is 10 millimeters.

9. The vehicle headlamp assembly of claim 1, wherein the first elongated light emitting portion is oriented horizontally with respect to the vehicle headlamp assembly, and the second elongated light emitting portion is oriented vertically with respect to the vehicle headlamp assembly.

10. A light guide for illuminating a target area comprising:

a first light source;

a second light source;

first and second input portions;

first and second elongated light emitting portions each having a cylindrical-shaped cross-section, the first and second light emitting portions diverging from each other;

a mixing portion extending between the first input portion and the first light emitting portion, and between the second input portion and the second light emitting portion, the mixing portion comprising a top surface, an opposite facing bottom surface, a back side facing toward the first and second input portions, a front side facing toward the outer cover in an area between the diverging first and second light emitting portions, a first side disposed along at least a part of the first input portion and a part of the first light emitting portion, and a second side disposed along at least a part of the second input portion and a part of the second light emitting portion; and first reflectors disposed along at least part of the first side of the mixing portion and along at least a part of the first light emitting portion, and second reflectors disposed along at least part of the second side of the mixing portion and along at least a part of the second light emitting portion, wherein light generated by the first light source is guided from a first end of the first input portion toward a second end of the first light emitting portion and transversely with respect to the target area, and light generated by the second light source is guided from a third end of the second input portion toward a fourth end of the second light emitting portion and transversely with respect to the target area, wherein a portion of light guided from the first end to the first input portion toward the second end of the first light emitting portion is reflected into the mixing portion via the first reflectors and a portion of the light guided from the third end of the second input portion toward the fourth end of the second light emitting portion is reflected into the mixing portion via the second reflectors, the mixing portion is configured to receive light guided from the first end of the first input portion toward the second end of the first light emitting portion and configured to receive light guided from the third end of the second input portion toward the fourth end of the second light emitting portion, the mixing portion configured to emit the received light toward the designated target area, wherein the first and second light emitting portions each emit its guided light along at least a portion of its length and toward the designated target area, and wherein the front side of the mixing portion is a convex shape that emits the received light toward the outer cover and in the area between the diverging first and second light emitting portions.

11. The light guide of claim 10, wherein the first side and the second side of mixing portion are opposing sides, and wherein the back side is disposed adjacent to the first and second input portions and has a concave shape that faces the first and third ends of the first and second input portions, respectively, and the front side extends between the diverging first and second light emitting portions.

12. The light guide of claim 10, wherein the first reflectors are disposed along a portion of the light guide chosen from the first input portion, the mixing portion and the first light emitting portion, and wherein the second reflectors are disposed along a portion of the light guide chosen from the second light emitting portion and the mixing portion, the first and second reflectors disposed along a back side of the light guide that is opposite a surface of the light guide that emits the guided light toward an outer cover.

13. The light guide of claim 12, wherein the mixing portion has opposing first and second sides, and wherein the first side is disposed adjacent to the first and second input portions and has a concave shape that faces the first and third ends of the first and second input portions, respectively, and the second side extends between the diverging first and second light emitting portions.

14. The light guide of claim 10, wherein the mixing portion has a thickness between 2.5 mm and 3 mm.

15. The light guide of claim 10, wherein the first and second input portions, the first and second light emitting portions and the mixing portion are made of a polycarbonate transparent material.

16. The light guide of claim 10, wherein the first side and second input portions are parallel to each other and spaced apart, and the back side extends between the first side and second input portions.

17. The light guide of claim 10, wherein the diameter of any of the first side and second input portions and the first and second elongated light emitting portions is 10 millimeters.

18. The light guide of claim 10, wherein the first elongated light emitting portion is oriented horizontally with respect to the vehicle headlamp assembly, and the second elongated light emitting portion is oriented vertically with respect to the vehicle headlamp assembly.

19. A vehicle headlamp assembly having first and second light sources, the vehicle headlamp assembly comprising:

a base defining a cavity;

an outer cover attached to the base to enclose the cavity; and a light guide disposed within the cavity of the base, the light guide comprising:

first and second input portions extending substantially parallel to each other;

first and second elongated light emitting portions each having a cylindrical-shaped cross-section, the first light emitting portion diverging from the second input portion and the second light emitting portion, the second light emitting portion diverging from the first input portion and the first light emitting portion;

a mixing portion extending between the first input portion and the first light emitting portion, and between the second input portion and the second light emitting portion, the mixing portion comprising a top surface facing toward the outer cover, an opposite facing bottom surface, a back side facing toward the first and second input portions, a front side facing toward the outer cover in an area between the diverging first and second light emitting portions, a first side disposed along at least a part of the first input portion and a part of the first light emitting portion, and a second side disposed along at least a part of the second input portion and a part of the second light emitting portion; and first reflectors disposed along at least part of the first side of the mixing portion and along at least part of the first light emitting portion, and second reflectors disposed along at least part of the second side of the mixing portion and along at least part of the second light emitting portion, wherein light generated by the first light source is guided from a first end of the first input portion toward a second end of the first light emitting portion and parallel to the outer cover, and light generated by the second light source is guided from a third end of the second input portion toward a fourth end of the second light emitting portion and parallel to the outer cover, wherein a portion of light guided from the first end of the first input portion toward the second end of the first light emitting portion is reflected into the mixing portion via the first reflectors and a portion of the light guided from the third end of the second input portion toward the fourth end of the second light emitting portion is reflected into the mixing portion via the second reflectors, wherein the first and second light emitting portions each emit its guided light along at least a portion of its length and toward the outer cover, and wherein the front side of the mixing portion is a convex shape that emits the received light toward the outer cover in the area between the diverging first and second light emitting portions.

20. The headlamp assembly of claim 19, wherein the mixing portion is configured to receive light guided from the first end of the first input portion toward the second end of the first light emitting portion and configured to receive light guided from the third end of the second input portion toward the fourth end of the second light emitting portion, the mixing portion is configured to emit the received light toward the outer cover.

21. The headlamp assembly of claim 19, wherein the mixing portion has a thickness between 2.5 mm and 3 mm.

22. The headlamp assembly of claim 19, wherein the first and second input portions, the first and second light emitting portions and the mixing portion are made of a polycarbonate transparent material.

23. The vehicle headlamp assembly of claim 19, wherein the first side and the second side of the mixing portion are opposing sides, and wherein the back side is disposed adjacent to the first and second input portions and has a concave shape that faces the first and third ends of the first and second input portions, respectively, and the front side extends between the diverging first and second light emitting portions.

24. The headlamp assembly of claim 19, wherein the first reflectors are disposed along a portion of the light guide chosen from the first input portion, the mixing portion and the first light emitting portion, and wherein the second reflectors are disposed along a portion of the light guide chosen from the second light emitting portion and the mixing portion, the first and second reflectors disposed along a back side of the light guide that is opposite a surface of the light guide that emits the guided light toward the outer cover; and the mixing portion has opposing first and second sides, and wherein the first side is disposed adjacent to the first and second input portions and has a concave shape that faces the first and third ends of the first and second input portions, respectively, and the second side extends between the diverging first and second light emitting portions.

25. The vehicle headlamp assembly of claim 19, wherein the first side and second input portions are parallel to each other and spaced apart, and the back side extends between the first side and second input portions.

26. The vehicle headlamp assembly of claim 19, wherein the diameter of any of the first side and second input portions and the first and second elongated light emitting portions is 10 millimeters.

27. The vehicle headlamp assembly of claim 19, wherein the first elongated light emitting portion is oriented horizontally with respect to the vehicle headlamp assembly, and the second elongated light emitting portion is oriented vertically with respect to the vehicle headlamp assembly.

* * * * *